US007779608B2

(12) United States Patent
Lim et al.

(10) Patent No.: US 7,779,608 B2
(45) Date of Patent: Aug. 24, 2010

(54) PRESSURIZED CONTAINERS AND METHODS FOR FILLING THEM

(76) Inventors: Walter K. Lim, P.O. Box 2409, Rancho Santa Fe, CA (US) 92067-2409; Arthur A. Krause, 20539 Archwood St., Winnetka, CA (US) 91306

( * ) Notice: Subject to any disclaimer, the term of this patent is extended or adjusted under 35 U.S.C. 154(b) by 0 days.

(21) Appl. No.: 11/805,995

(22) Filed: May 26, 2007

(65) Prior Publication Data

US 2008/0185067 A1 Aug. 7, 2008

Related U.S. Application Data

(60) Provisional application No. 60/899,314, filed on Feb. 2, 2007.

(51) Int. Cl.
*B65B 31/00* (2006.01)
*B65B 31/10* (2006.01)

(52) U.S. Cl. ..... 53/403; 53/431; 53/470; 53/510

(58) Field of Classification Search ..... 53/403, 53/431, 432, 470, 510, 511; 141/2, 3, 20, 141/9

See application file for complete search history.

(56) References Cited

U.S. PATENT DOCUMENTS 2,954,935 A * 10/1960 Stearns et al. ..... 239/373
3,020,688 A * 2/1962 Modderno ..... 53/425
3,371,460 A * 3/1968 Rait ..... 53/440
3,583,609 A * 6/1971 Oppenheimer ..... 222/402.25
3,659,395 A 5/1972 Morane
3,777,934 A 12/1973 Meeks et al.
3,797,534 A * 3/1974 Skidmore ..... 141/3
3,972,446 A 8/1976 Williams et al.
4,049,158 A 9/1977 Lo
4,431,120 A 2/1984 Burger
4,494,668 A 1/1985 Lottick
4,896,794 A * 1/1990 Banks et al. ..... 222/1
5,032,619 A 7/1991 Frutin et al.
5,256,400 A 10/1993 Froix et al.
5,285,931 A 2/1994 Alfons
5,688,238 A 11/1997 Moser
RE35,843 E 7/1998 Diamond et al.
6,230,943 B1 5/2001 Miyamoto et al.
6,427,928 B1 8/2002 Hirota
6,519,919 B1 * 2/2003 Takenouchi et al. ..... 53/431
6,675,981 B1 1/2004 Lesko
6,708,844 B2 3/2004 Lim et al.

(Continued)

FOREIGN PATENT DOCUMENTS

GB 1542322 3/1979

*Primary Examiner*—Hemant M Desai
(74) *Attorney, Agent, or Firm*—Dennis H. Lambert

(57) ABSTRACT

According to a first aspect of the invention a can manufacturer completes manufacture of a can and then ships it to a filler, who needs only to fill the can with product. In a preferred embodiment the manufacturer pre-charges the container with a propellant. In accordance with a second aspect of the invention a desired quantity of gaseous propellant is first charged into a container, and a desired quantity of product is then injected into the container. A container filled in accordance with the invention maintains a predetermined pressure in the container as product is depleted from the container, and unacceptable pressure spikes are avoided as the container is being filled.

15 Claims, 6 Drawing Sheets

U.S. PATENT DOCUMENTS

| | | | | |
|---|---|---|---|---|
| 6,745,922 | B1 | 6/2004 | Vlooswijk et al. | |
| 6,824,079 | B2 | 11/2004 | Kendrick et al. | |
| 6,939,394 | B2 | 9/2005 | Carruthers | |
| 7,014,127 | B2 | 3/2006 | Valpey, III et al. | |
| 7,131,602 | B2 | 11/2006 | Otomo et al. | |
| 7,201,191 | B2 * | 4/2007 | Heatley et al. | 141/9 |
| 2006/0049215 | A1 | 3/2006 | Lim et al. | |
| 2007/0240387 | A1 * | 10/2007 | Smith | 53/470 |

* cited by examiner

PRESSURIZED CONTAINERS AND METHODS FOR FILLING THEM

This application claims the benefit of U.S. provisional patent application Ser. No. 60/899,314, filed Feb. 2, 2007, the disclosure of which is incorporated in full herein by reference.

BACKGROUND OF THE INVENTION

1. Field of the Invention

This invention relates to pressurized containers and to methods for pressurizing and filling them. In accordance with a first aspect of the invention, the containers are completed by the container manufacturer and shipped ready to be filled. In a preferred embodiment a propellant is introduced into the completed container by the manufacturer before the container is shipped to a filler to be filled with product. According to a second aspect of the invention the container is pressurized and filled in a way to ensure that the container is not excessively pressurized during filling and an adequate pressure is maintained in the container until all or substantially all of the product is depleted during use.

2. Prior Art

Pressurized containers are used to dispense a variety of products, including paint, lubricants, cleaning products, food items, personal care products such as hair spray, and the like. Pressure for dispensing these products is provided by a propellant placed in the container. In some prior art systems the product and propellant are stored separately in the container, i.e., separated by a barrier, e.g. a piston or bag, commonly referred as a barrier pack system. In other systems the product and propellant are stored together under pressure in the container. Dispensing of the product occurs when a discharge valve or nozzle is opened, permitting the pressurized product to be forced out through the nozzle, usually as a spray, stream, or foam. As product is depleted from the container, the pressure exerted by the propellant decreases, especially evident when compressed gases are used as the propellant, and the propellant pressure may become diminished to the extent that all of the product cannot be dispensed from the container, or a desired characteristic, e.g., atomization, is not achieved.

In addition to the propellant component, many products, e.g., hair spray, require a carrier, e.g., alcohol, or combinations of alcohol with water or other volatile solvents that dry quickly upon discharge from the container. Other volatile solvents or propellants that can be used in these systems include volatile organic compounds (VOCs) such as propane, isobutane, dimethyl ether, and the like, but their use is limited due to environmental concerns. For instance, under some current regulations no more than 55% of the contents of the container can comprise a VOC. In an aerosol dispenser, as much as 25% of the VOC could be required for use as a propellant, leaving about 30% VOC in the product. The balance of the product would be the active ingredients and water, which does not dry as quickly as the VOC, resulting in a "wet" product when used.

Carbon dioxide ($CO_2$) is useful as an aerosol propellant, but its use has been limited due to the fact that it is normally placed in the container as a pressurized or compressed gas, and in conventional systems the drop-off in pressure is excessive as the product is depleted and the volume occupied by the propellant increases. For example, in a typical situation the starting pressure might be 90-125 psig and the finishing pressure only 20 or 30 psig.

Conventional barrier pack systems typically comprise a can made of aluminum, steel, plastic, or other suitable material, with a barrier in the can between the product and the propellant. The barrier normally comprises a piston reciprocable in the can, or a collapsible bag in which the product is contained. In accordance with conventional practice, barrier pack cans are shipped empty from the manufacturer to a location where the can is to be filled, either with a piston in place in the can or a bag attached to the valve or the dome closing the end of the can. The filler adds the product, crimps and seals the valve in place in the opening provided for that purpose in the domed top of the can, and then injects the propellant.

If the barrier pack is of the type having a piston, the filler normally introduces product, e.g., a gel, through the opening in the domed top and into the can above the piston. The aerosol valve is then fitted and sealed to the can, and a propellant such as, e.g., isobutane, a VOC, is introduced under a predetermined pressure into the can beneath the piston through a sealing plug in the bottom of the can. If a liquefied propellant is used, some of it vaporizes until an equilibrium pressure is reached. The pressurizing propellant forces the piston up, placing pressure on the product so that it is discharged through the valve when the valve is opened.

In barrier packs utilizing a bag wherein the bag is affixed to the valve body on the bottom side of the valve cup with an undercup gasser, the filler introduces a propellant around the valve and into the can outside the bag, crimps the can, and then introduces product into the bag through the valve. Alternatively, a second method utilizes a plastic bag that is preinserted into the can and that has a formed one-inch neck shaped to fit the curl of the can, which allows product to be filled before the valve is applied and sealed. Propellant is then added through the sealing plug in the bottom of the can. The propellant exerts pressure on the bag, forcing product out through the valve when the valve is opened.

In those conventional systems wherein the propellant is mixed in the container with the product, the can manufacturer ships an empty container to the filler, who then places a desired quantity of product into the container, attaches and seals the valve, and then injects propellant through the valve to pressurize the product.

In order to promote dissolution of the propellant into the product as the propellant is being introduced, some prior systems shake the container, thereby reducing the pressure spike or over-pressurization that occurs when the propellant is first charged into the container and thus avoiding deformation of the can. However, these prior art systems have not been entirely satisfactory because of slower gassing and the shaking required.

Various other systems have been developed in the prior art for storing a reserve supply of propellant and adding it to the container as product is depleted, so that propellant pressure is maintained at a desirable level until a suitable amount of the product is dispensed from the container. Examples of such systems are described in applicant's prior issued U.S. Pat. Nos. 6,708,844 and 7,185,786, and applicant's prior copending U.S. application Ser. No. 11/250,235, filed Oct. 14, 2005, all of which are incorporated in full herein by reference.

Common to the foregoing systems is the need for the filler to provide machinery for completing manufacture and/or assembly of the final product, and in the case of pressurized aerosol dispensers to inventory propellants and solvents in addition to the product. For many small fillers, in particular, this is a burdensome requirement due to the cost of the necessary machinery to complete manufacture of the containers and to store propellant gases, and when applicable the cost of carrying insurance and maintaining appropriate storage facilities for required propellants and solvents.

It would be advantageous to have an economical, efficient, and environmentally safe system and method for filling and pressurizing containers, wherein completed containers are shipped by the container manufacturer to the filler so that the filler does not require the necessary equipment to complete the vacuum crimping, propellant gas injection, gas storage tanks, and pumping equipment to complete the manufacture of the pressurized product, and does not need to incur the cost of carrying insurance and maintaining manufacturing and appropriate storage facilities for required propellants. Moreover, it would be advantageous to have a system and method for filling and pressurizing containers wherein the initial starting pressure is not excessive and satisfactory pressure is maintained throughout the useful life of the container.

SUMMARY OF THE INVENTION

According to a first aspect of the invention, a system and method is provided wherein the container manufacturer completes manufacture of a container before shipping it to the filler by attaching the valve and sealing the can so that the filler does not have to purchase the machinery necessary to complete manufacture of the containers. Preferably, and especially for pressurized aerosol dispensers, the manufacturer pre-charges the completed container with a desired quantity of propellant prior to shipping it to the filler, whereby the filler does not need to incur the cost of carrying insurance and maintaining appropriate storage facilities for the various propellants and solvents, requiring only product injectors.

According to a second aspect of the invention, a system and method is provided for filling and pressurizing containers, wherein a propellant is first charged into the container and product is then introduced in a way to ensure that the initial starting pressure is not too great and satisfactory pressure is maintained until substantially all product has been dispensed. This aspect of the invention could be practiced independently of the first aspect, i.e., the can manufacturer could ship a can empty to the filler, who would then introduce both the propellant and the product into the container, or in conjunction with it.

In this second aspect, the pressure of the compressed gas propellant pre-charged into the container typically is from about 40 psig to about 150 psig, and the line pressure of the product in the filling machine typically is in the range of about 600 psig. The desired quantity of product is charged into the container very quickly, typically over a time interval of only about 0.5 to 1.0 second. However, the restriction imposed by the container valve through which the product is introduced substantially reduces the pressure of the product from its line pressure, and some of the gaseous propellant is dissolved into the product as it is being violently introduced into the container, whereby the initial pressure in the container does not exceed about 160 psig as it is being filled. This pressure is well within acceptable limits. Applicant has determined that by filling and pressurizing the container in this way, enough propellant gas is in the container to obtain a satisfactory discharge pressure until substantially all the product has been dispensed, and the initial pressurization of the container during filling is kept within acceptable limits.

In a preferred embodiment, the product is chilled to a temperature of from about 34° F. to about 40° F. before it is introduced into the container. This promotes more rapid dissolution of compressed gaseous propellant into the product, helping to minimize or eliminate the pressure spike that might otherwise occur when the product is charged into the previously pressurized container.

In a further preferred embodiment, the product is introduced into the container in multiple steps, with only a portion of the product being introduced in each step. This also promotes dissolution of some of the propellant into the product, and provides more time for such dissolution to occur, further improving the ability of the invention to reduce or eliminate sharp increases in pressure in the container as it is being filled.

In another preferred embodiment, a predetermined quantity of dry ice ($CO_2$ in solid form) is placed in the container prior to the top of the container being applied and sealed as the container moves along the filling line. During the relatively short span of time between adding the dry ice and applying the top some of the $CO_2$ gases off, purging the container and thereby eliminating the need to purge the container in a separate step. The desired quantity of product is then injected into the container, and since most of the $CO_2$ is still in the form of dry ice the pressure in the container is relatively low. Thus, the increase in pressure caused in the container as the product is injected is minimal and well below an acceptable level. Thereafter, the $CO_2$ continues to gas off until an equilibrium pressure is reached, which typically is in the range of from about 90 psig to about 130 psig.

In yet another preferred embodiment, a material in which $CO_2$ readily and rapidly dissolves can be added to the product before the product is injected into the container. This will increase the speed with which $CO_2$ is dissolved in the product, helping to minimize any pressure spike that might occur when the product is injected into the container. Such materials may include acetone and comparable materials, depending upon their suitability for use in the product being packaged. Moreover, as part of their normal formulation many products contain a material in which $CO_2$ readily dissolves. Alcohol is an example.

In a still further preferred embodiment, a quantity of gas adsorption material is placed in the container to adsorb and store gaseous propellant. This material quickly adsorbs gaseous propellant when it is subsequently charged into the container, thereby substantially reducing the volume of propellant gas present in the container and thus minimizing the spike in pressure that would otherwise occur when the product is injected into the container. After the container is sealed and filled, the sorbed gas is slowly released from the sorbent material until equilibrium pressure is reached in the container, and continues to be released to maintain a desirable pressure as product is depleted from the container during use. The quick adsorption of the propellant gas into the sorbent material during pressurization, and its subsequent slow release until equilibrium pressure is reached avoids distortion of the can during pressurization. A preferred sorbent material is zeolite, and a preferred propellant gas is carbon dioxide, but other sorbents and/or gases may be used, as more fully described in applicant's copending application Ser. No. 11/250,235, filed Oct. 14, 2005, the disclosure of which is incorporated herein in its entirety by reference. As disclosed in that application, a preferred sorbent material is activated carbon, or a carbon fiber composite molecular sieve (CFCMS) as disclosed, for example, in U.S. Pat. Nos. 5,912,424 and 6,030,698, the disclosures of which are incorporated in full herein. Other materials, such as natural or synthetic zeolite, starch-based polymers, alumina—preferably activated alumina, silica gel, and sodium bicarbonate, or mixtures thereof, may be used to adsorb and store a quantity of a desired gas, although they generally are not as effective as activated carbon. Zeolite is particularly effective at adsorbing and desorbing $CO_2$, especially if calcium hydroxide is added to the zeolite during its manufacture. Other base materials, such as potassium or sodium hydroxide, or lithium hydroxide or sodium carbonate, for example, could be used in lieu of calcium hydroxide.

The sorbent material may be in the form of a cohesive body, such as a ball, tube, cube or rod, or sheet or screen which may be flat or curved or folded into various shapes, such as, for example, an accordion-like fold. Alternatively, the sorbent material may be granular or powdered and enclosed in a membrane or pouch that is porous to the gaseous propellant and/or to the product in the container.

All or any number of the above approaches could be combined in a single process to obtain the combined benefits of each.

In accordance with a specific process for manufacturing, filling and pressurizing aerosol dispensers according to the second aspect of the invention, the discharge valve is crimped and sealed on a can, preferably by the can manufacturer in accordance with the first aspect of the invention, but the second aspect is applicable whether this is done by the can manufacturer or by the filler. A vacuum is then applied to the can to evacuate it. A measured amount of propellant, and in some cases solvent, is then charged into the container using suitable conventional equipment, either by equilibrium pressure (balance between pressure in the container and pressure in the gas supply line, typically about 125 psig) or a metering piston (gas cylinder injector) that injects a measured quantity of gas. A measured quantity of product, chilled to from about 34° F. to about 40° F., is then injected into the container with a metering piston.

Suitable propellants and/or solvents may include, but are not necessarily limited to: carbon dioxide; nitrogen; acetone; alcohol; argon (a preservative); propane; n-butane; isobutane (2-methylpropane); dimethyl ether; HFC-152a (1,1-difluoroethane); HFC-134a (1,2,2,2-tetrafluoroethane); nitrous oxide; ethyl fluoride ($CH_3$—$CH_2F$); fluoro-ethers (e.g., $CHF_2$—O—$CH_3$); and compressed air; or combinations of these.

It should be understood that the size of the container, the formulation and quantity of the product, and the initial starting pressure of the propellant in the container can vary within the scope of the invention. Also, the amounts or proportions of the propellants can be varied to suit particular needs.

It is contemplated that by practicing the invention the amount of VOCs in various products could gradually be reduced over a period of time. That is, ever increasing amounts of an inert and/or environmentally friendly propellant and/or solvent could gradually be substituted for the VOCs in succeeding generations of containers.

It should be understood that the invention is applicable to cans made of aluminum, steel, or other material and is not limited to cans made of any particular material, and applies to cans made of one piece, two pieces, three pieces, or other constructions.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figure 1A:
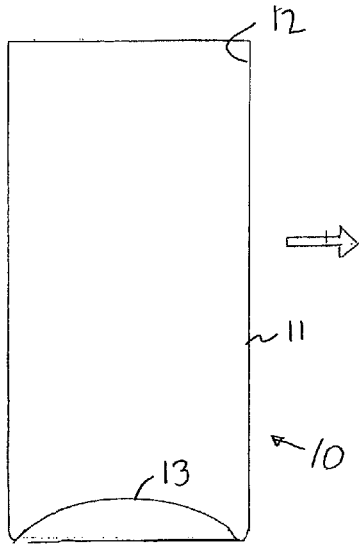
FIG. 1A (PRIOR ART)
FIG. 1A is a longitudinal sectional view of a can shell for a pressurized dispenser, wherein the can shell and bottom are made in one piece, typically of aluminum.
Figure 1B:
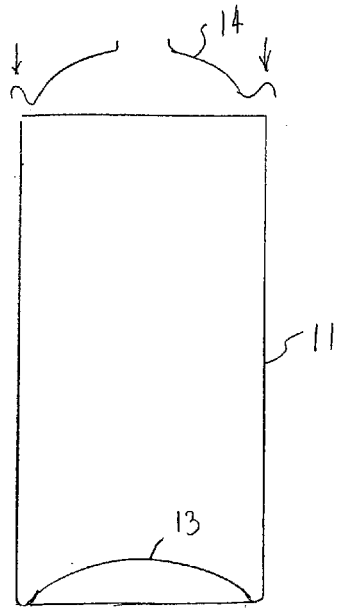
FIG. 1B (PRIOR ART)
FIG. 1B is a longitudinal sectional view of a can produced by applying a domed end to the open end of the shell of FIG. 1A.
Figure 2A:
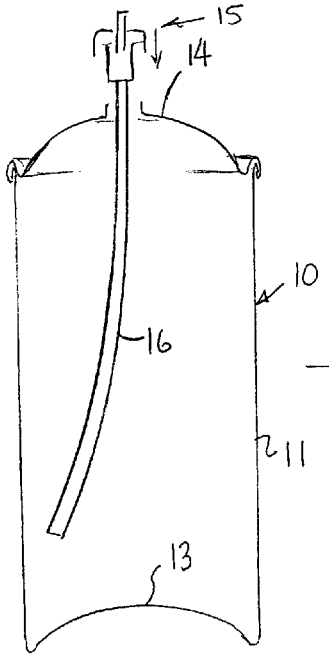
FIG. 2A (PRIOR ART)
FIGS. 2A, 2B and 2C are longitudinal sectional views of the can of FIG. 1B, showing the different stages performed by a filler in completing the product, including attaching the valve to the can, filling the can it with product, and pressurizing it according to conventional practice.
Figure 2B:
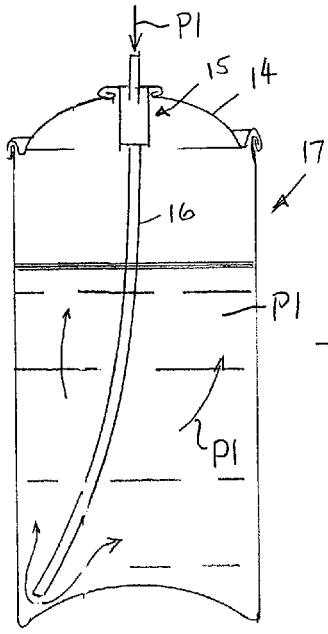
FIG. 2B (PRIOR ART)
Figure 2C:
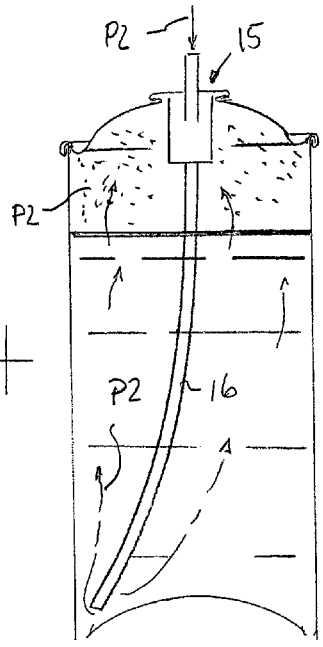
FIG. 2C (PRIOR ART)

A can shell from which a typical pressurized aerosol dispenser is made is indicated generally at 10 in FIG. 1A. In the particular example shown, the shell comprises a one-piece body normally made of aluminum, and has a cylindrical side wall 11 with an open top 12 and an integrally formed bottom 13. As shown in FIG. 1B, a domed top 14 with an opening 14' through its center is crimped and sealed to the open top 12 to form a can. The can shown in FIG. 1B is what the manufacturer produces and ships to a filler, who fills the can with product, attaches and seals the valve in the opening 14', and pressurizes the can with propellant, as depicted in FIGS. 2A-2C. In FIG. 2A the discharge valve assembly 15 and dip tube 16 are being assembled to the top 14 to produce a completed aerosol can with top and discharge valve, as indicated generally at 17 in FIG. 2B. The filler then performs the steps shown in FIGS. 2B and 2C. FIG. 2B depicts the product P1 being added by injecting it through the valve 15, and in FIG. 2C the propellant P2 is being added.

Figure 4:
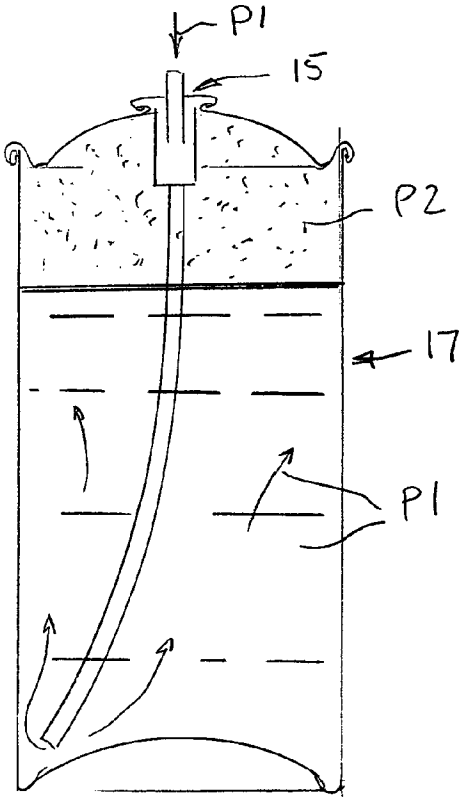
FIG. 4 depicts the step of filling the container of FIG. 3 with product, as performed by the filler.
Figure 3:
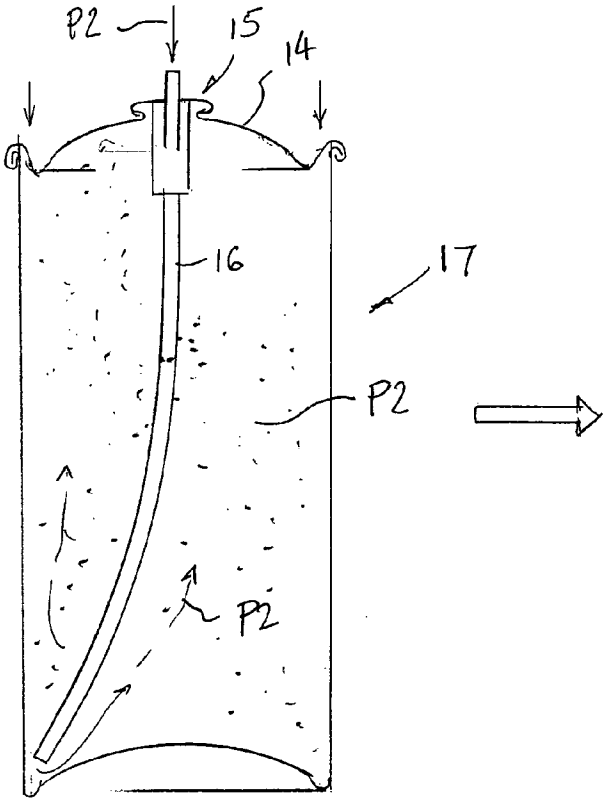
FIG. 3 is a longitudinal sectional view of a can for a pressurized dispenser as manufactured in accordance with the invention, wherein manufacture of the can is completed and propellant is charged into the can prior to shipment to a filler.

In accordance with the first aspect of the invention, as illustrated in FIGS. 3 and 4, the can manufacturer completes assembly of the can 17 by crimping and sealing the valve assembly 15 in place, and also adding propellant P2, all as shown in FIG. 3. The completed can 17, pre-charged with propellant, is then shipped to the filler where it is necessary only to add product P1, as depicted in FIG. 4. The product may be added in accordance with the second aspect of the invention, as described more fully hereinafter and as illustrated in FIGS. 5-22.

Figure 5:
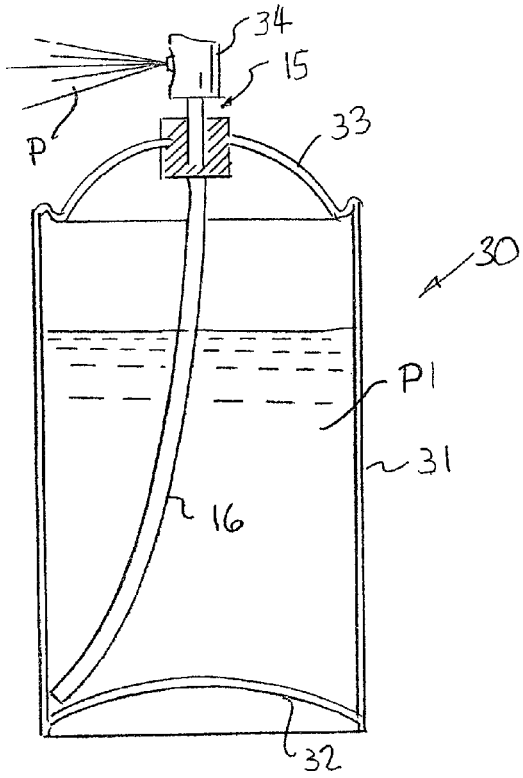
FIG. 5 is a longitudinal sectional view of a pressurized dispensing container.

A typical aerosol dispenser is indicated generally at 30 in FIG. 5. The dispenser includes a container 31 made of metal or other suitable material, having a bottom 32 and a top 33. A discharge valve assembly 15 is mounted on the top and includes a nozzle 34 that may be manually depressed to open and permit product P1 to be dispensed from the container through the nozzle. A dip tube 16 extends from the bottom of the container to the discharge nozzle assembly. As seen in FIG. 5, the level of product in the container does not occupy the entire volume of the container, and the space above the product level is filled with a pressurized propellant gas to exert pressure on the product and force it through the dip tube and nozzle when the nozzle is depressed. The foregoing structure and operation are conventional, and further detailed description of these basic components and their operation is not believed necessary.

Figure 6:
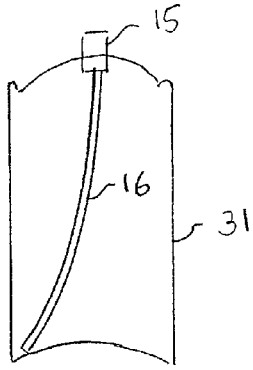
FIG. 6 is a somewhat schematic longitudinal sectional view showing a sealed container with a discharge valve and dip tube applied to the domed end.
Figure 7:
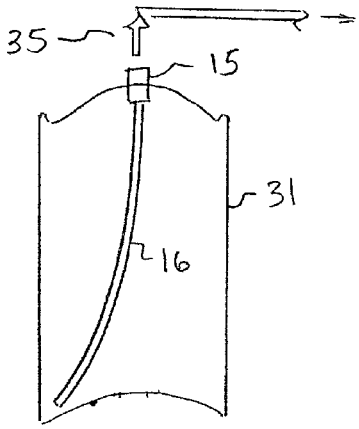
FIG. 7 is a view similar to FIG. 6, showing a vacuum being drawn on the container to remove air.
Figure 8:
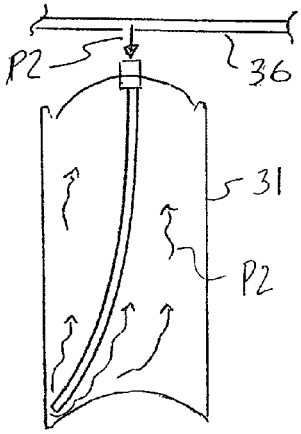
FIG. 8 is a view similar to FIG. 6, showing a propellant gas being charged into the container through the valve assembly at the top.

In accordance with the second aspect of the invention, the valve assembly 15 and dip tube 16 are applied and the container 31 is sealed, as depicted in FIG. 6. Air is then evacuated from the container by applying a vacuum to it, as shown at 35 in FIG. 7. A predetermined quantity of gaseous propellant P2 is then charged into the container as indicated in FIG. 8. The propellant may be introduced using conventional equipment, such as by pressure equilibrium, wherein the gas is charged into the container until the pressure in the container equals the pressure in the gas supply line 36, typically about 125 psig, or by injecting a metered quantity of the propellant using a metering piston or gas cylinder injector (not shown).

Figure 9:
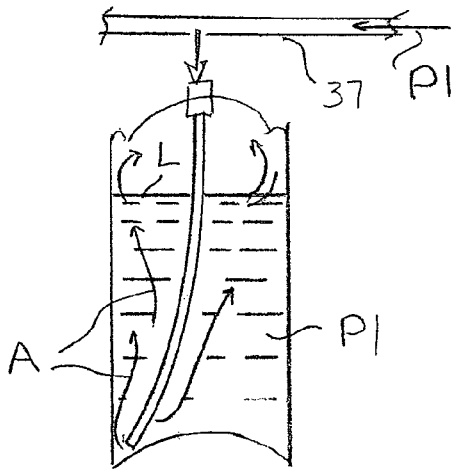
FIG. 9 is a view similar to FIG. 6, showing product being introduced into the container in a single step and depicting how the product swirls around the interior of the container as it is introduced.

A metered quantity of product P1 is then introduced into the container using conventional equipment such as, for example, a piston injector (not shown). As depicted in FIG. 9, the product may be injected in a single step. The pressure in the product supply line 37 typically is in the range of about 600 psig and it takes only about 0.5 to 1.0 second to inject the desired quantity into the container, whereby the product is relatively violently introduced into the container. The pressure of the product entering the container is substantially less than the line pressure, but immediately upon the product being introduced into the container, some spike or transitory increase in pressure might be expected, although this transitory increase is only about 160 psig and is well below acceptable limits. Whether this occurs, the pressure is sufficient to induce considerable swirling and agitation of the product, as illustrated by the arrows "A". This movement of the product as it is being introduced into the container results in thorough mixing and intermingling of the product and propellant, enhancing the speed with which some of the gaseous propellant is dissolved in the liquid product. The propellant not dissolved in the product quickly moves to the top of the container, filling the head space between the product level "L" and the domed container top, applying a pressure of about 125 psig on the product. In this regard, it should be understood that the initial or starting pressure in the container may have other values, depending upon the desired result.

Figure 10:
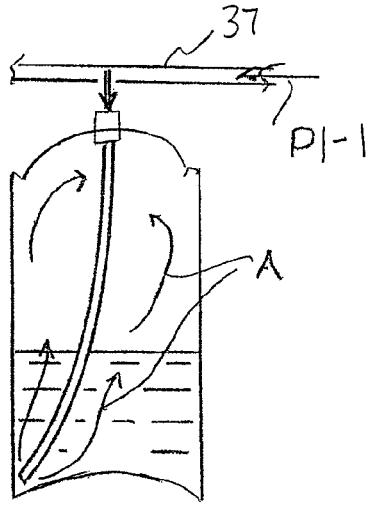
FIGS. 10 and 11 are views showing the product being introduced into the container in two steps, with approximately half the product being introduced in FIG. 10, and the balance being introduced in FIG. 11.
Figure 11:
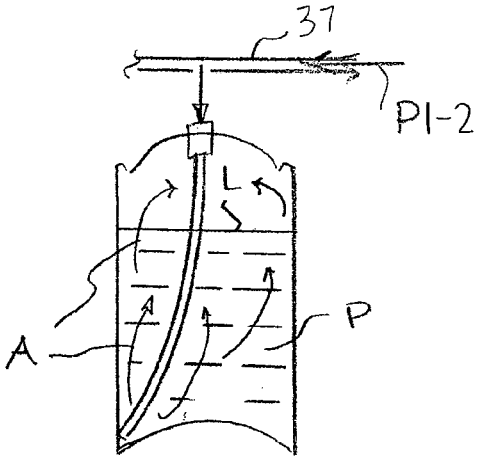

FIGS. 10 and 11 depict an alternate filling method, wherein the product is injected into the container in two steps, each step involving a smaller quantity of product than is injected in the single step approach of FIG. 9. Thus, as shown in FIG. 10, a first quantity of product P1-1 equal to approximately one half of the final desired amount of product to be placed in the container is introduced in a first step, and as shown in FIG. 11 a second quantity P1-2, or the balance of the desired amount to fill the container, is introduced in a second step. This approach reduces any transitory pressure spike caused by injection of the product into the container since less product is being introduced and the product takes up a commensurately smaller volume at each injection stage. The delay between the first and second stages, although very small, provides more time for propellant gas to be dissolved in the product.

Figure 12:
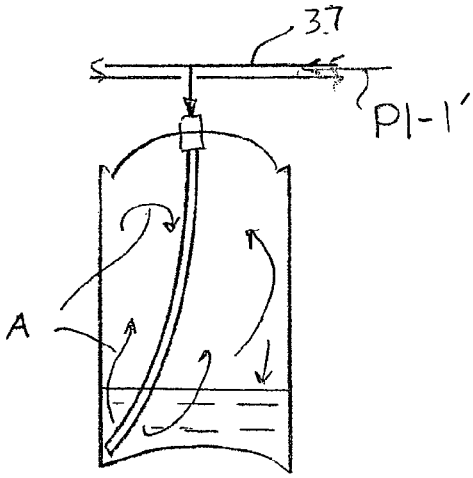
FIGS. 12, 13 and 14 are views showing the product being introduced into the container in three steps, with approximately one-third the product being introduced in FIG. 12, one-third being introduced in FIG. 13, and the balance being introduced in FIG. 14.
Figure 13:
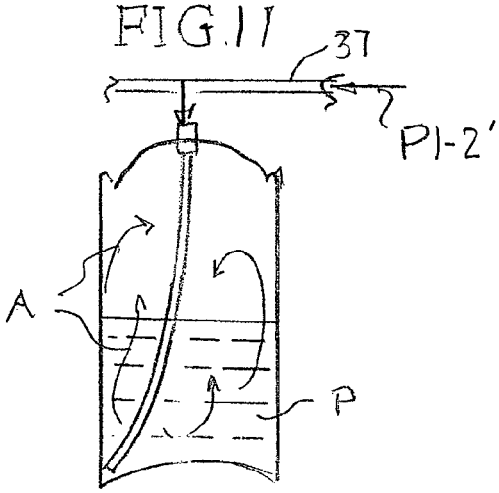
Figure 14:
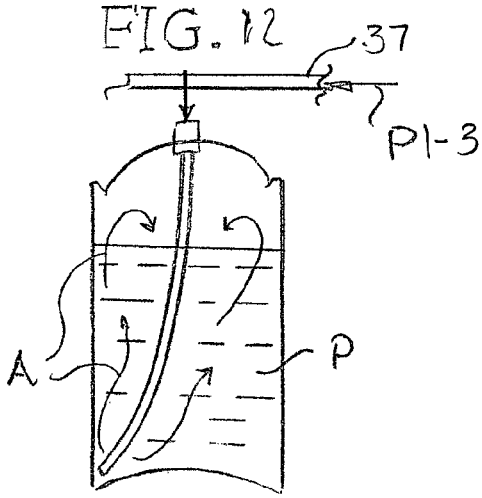
Figure 15:
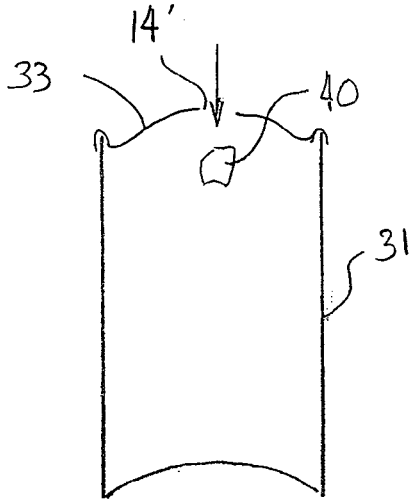
FIG. 15 shows a container prior to the valve being applied to the opening through the domed top, and depicting a quantity of dry ice being placed in the container through the opening.

FIGS. 12, 13 and 14 depict a further method, wherein the product is injected into the container in three steps or stages. Thus, as shown in FIG. 15, a first quantity of product P1-1' equal to about one-third the final amount of product desired in the container is injected in a first step, and second and third quantities P1-2' and P1-3 are injected in respective succeeding steps.

Figure 16:
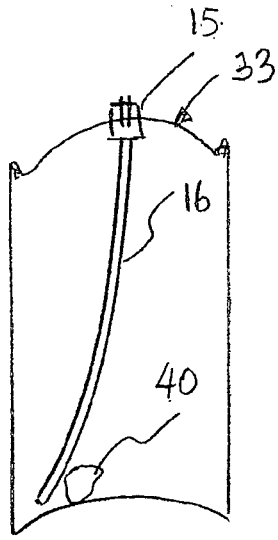
FIG. 16 shows the container of FIG. 15 after the valve has been applied.
Figure 17:
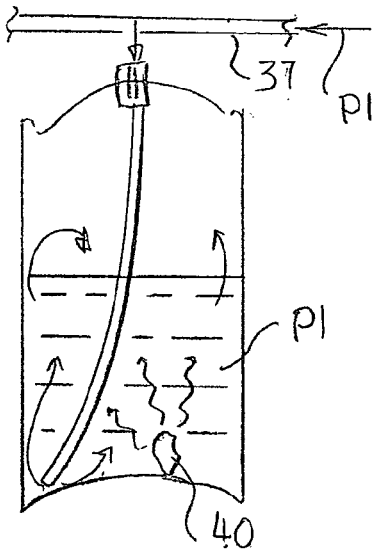
FIG. 17 shows a subsequent stage during which product is injected into the container.
Figure 18:
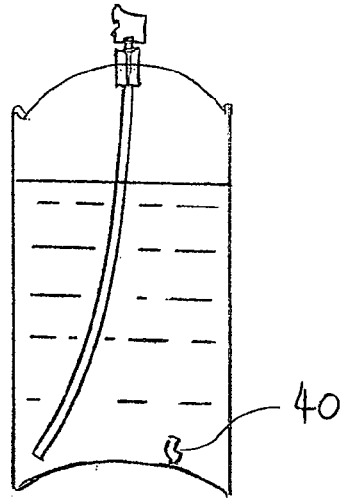
FIG. 18 shows the completed and filled container.
Figure 19:
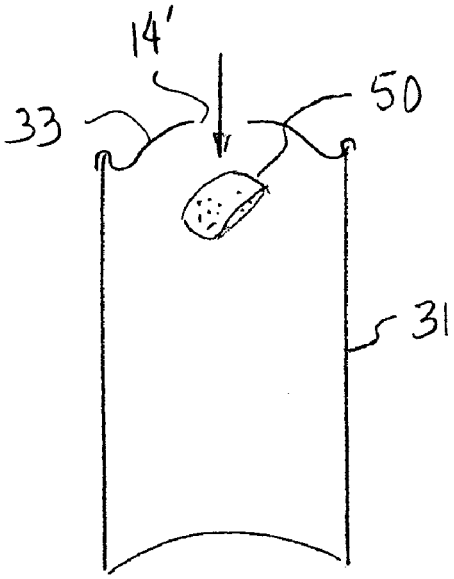
FIG. 19 is a view similar to FIG. 15, but showing a quantity of sorbent material being placed in the container before the valve is applied and the container sealed.
Figure 22:
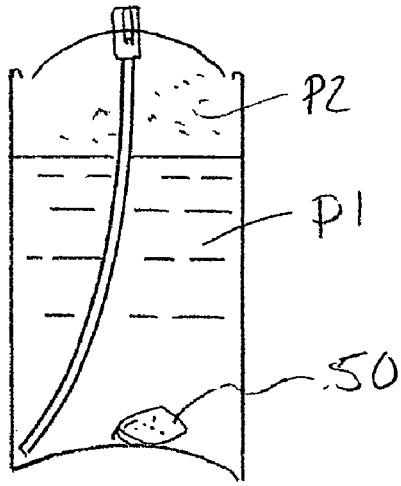
FIG. 22 shows the sealed and filled container, with the sorbent material disposed in the product.

In an alternative method as depicted in FIGS. 15-18, a quantity of dry ice 40 is placed in the container through the opening 14' before the valve assembly 15 is attached and sealed. As the container moves to the next station in the filling line, the dry ice begins vaporizing and the $CO_2$ given off floods the interior of the container, purging it. The valve assembly 15 is then attached and sealed to the body as depicted in FIG. 16. This is followed by injection of product P1, as previously described, and as shown in FIG. 17. The dry ice continues to vaporize until a starting equilibrium pressure is reached in the container, typically from about 90 psig to about 130 psig. The magnitude of this starting equilibrium pressure can be varied as desired, and depends to a primary extent on the quantity of dry ice placed in the container. At this point some of the dry ice may still remain, as shown in FIG. 22, providing a small reserve supply of $CO_2$.

A material in which $CO_2$ readily and rapidly dissolves can be added to the product before the product is injected into the container in any of the previously described forms of the invention. This will increase the speed with which $CO_2$ is dissolved in the product, helping to minimize any pressure spike that might occur when the product is injected into the container. Such materials may include acetone and comparable materials, depending upon their suitability for use in the product being packaged. Moreover, as part of their normal formulation many products contain a material in which $CO_2$ readily dissolves. Alcohol is an example.

To further enhance rapid dissolving of propellant gas in the liquid product, the product preferably is chilled to a temperature of from about 34° F. to about 40° F. before it is introduced into the container.

Figure 20:
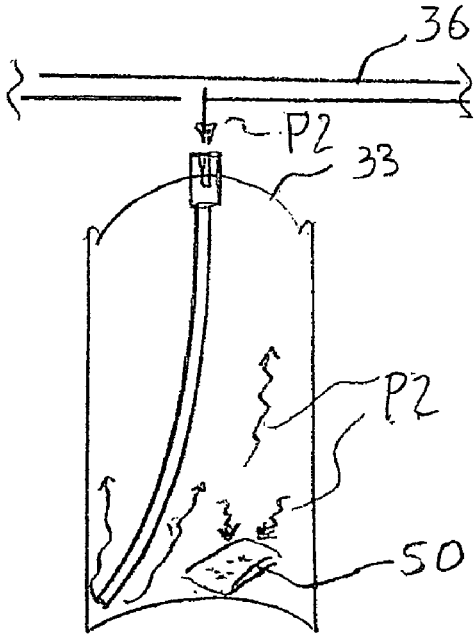
FIG. 20 shows the gaseous propellant being charged into the container of FIG. 19 after the valve has been attached and sealed to the container body and a vacuum has been applied to remove air.
Figure 21:
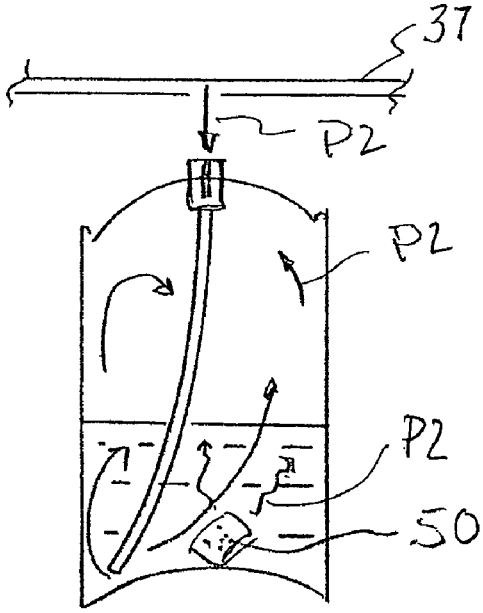
FIG. 21 depicts the step of injecting product into the container.

FIGS. 19-22 depict another alternate embodiment, wherein a predetermined quantity of adsorbent material 50 is placed in the container 31 through the opening 14' before the valve 15 is attached. The adsorbent material preferably comprises natural or synthetic zeolite, and may be in the form of a cohesive body, or granulated or powdered and confined in a pouch or membrane that permits fluid contact between the product and the sorbent. FIG. 20 depicts the container after it has been closed and sealed, and shows the gaseous propellant P2 being charged under pressure into the container from supply line 36. A substantial portion of the gaseous propellant is quickly adsorbed into the sorbent material, reducing the volume of gaseous propellant free in the container. A predetermined quantity of product P1 is then injected into the container from supply line 37. If the pressure in the container is not at the designed equilibrium pressure after it is filled with the desired quantity of product, some of the gaseous propellant is desorbed from the sorbent material until the equilibrium pressure is reached.

All or any number of the above approaches could be combined in a single process to obtain the combined benefits of each.

Pressurized dispensing containers filled in accordance with the invention have adequate pressure throughout their useful life (typically about 50 psig remaining when the container is empty of product) without requiring excess propellant to be initially charged into the container, and without incurring an unacceptable pressure spike during filling. The invention may be practiced with conventional equipment.

While particular embodiments of the invention have been illustrated and described in detail herein, it should be understood that various changes and modifications may be made to without departing from the spirit and intent of the invention.

What is claimed is:

1. A method of manufacturing and filling pressurized aerosol cans, comprising the steps of:

at the can manufacturer applying a discharge valve to a container, closing and sealing the container, and charging a desired quantity of gaseous propellant into the closed and sealed container from a source outside the container to pressurize it;

shipping the closed and sealed container pre-charged with pressurized gaseous propellant to a filler to be filled with product;

at the filler injecting a desired quantity of product into the container with the product; and shipping the filled and pressurized container to a point of sale.

2. A method as claimed in claim 1, wherein:

the propellant comprises gaseous carbon dioxide.

3. A method as claimed in claim 2, wherein:

the product and propellant are together in the same chamber; and the product contains a material in which $CO_2$ readily and rapidly dissolves.

4. A method as claimed in claim 3, wherein:

the material comprises acetone.

5. A method as claimed in claim 3, wherein:

the material comprises alcohol.

6. A method as claimed in claim 1, wherein :

the propellant is selected from the group consisting of: carbon dioxide; nitrogen; argon; propane; n-butane; isobutane (2-methylpropane); dimethyl ether; HFC-152a (1,1-difluoroethane); HFC-134a (1,2,2,2-tetrafluoroethane); nitrous oxide; ethyl fluoride ($CH_3$—$CH_2F$); fluoro-ethers (e.g., $CHF_2$—O—$CH_3$); and compressed air; and combinations of these.

7. A method as claimed in claim 1, wherein:

the product is a liquid and is chilled prior to being injected into the container.

8. A method as claimed in claim 1, wherein:

the product is a liquid and is injected into the container in a single step.

9. A method as claimed in claim 1, wherein:

the product is a liquid and is injected into the container in multiple stages.

10. A method as claimed in claim 1, wherein:

the propellant comprises gaseous carbon dioxide;

the product is a liquid and is chilled prior to being injected into the container; and the liquid product is injected into the container in multiple stages.

11. A method of filling a pressurized dispensing container so that a satisfactory pressure exists in the container throughout its useful life and unacceptable pressure spikes during filling of the container are avoided, comprising the steps of:

providing a container body having a top with an opening through it for attachment of a valve;

placing a predetermined quantity of dry ice through the opening and into the container;

permitting some of the dry ice to vaporize, filling the interior of the container with gaseous carbon dioxide, thereby purging the container;

applying and sealing a valve in the opening through the top of the container; and injecting a predetermined quantity of product into the container in multiple steps, wherein the dry ice continues to vaporize until a desired pressure is reached in the container.

12. A method as claimed in claim 11, wherein:

the product is chilled before it is injected into the container.

13. A method of filling a pressurized dispensing container so that a satisfactory pressure exists in the container throughout its useful life and unacceptable pressure spikes during filling of the container are avoided, comprising the steps of:

placing a quantity of gas adsorbing material in the container;

closing and sealing the container;

first charging a predetermined quantity of gaseous propellant under pressure into the container and adsorbing at least some of the propellant onto the sorbent material; and then injecting a predetermined quantity of product into the container in multiple steps.

14. A method as claimed in claim 13, wherein:

the product is chilled before it is injected into the container.

15. A method of filling a pressurized dispensing container so that a satisfactory pressure exists in the container throughout its useful life and unacceptable pressure spikes during filling of the container are avoided, comprising the steps of:

closing and sealing the container;

charging a predetermined quantity of propellant into the container to pressurize it; and then injecting a predetermined quantity of product into the container in multiple steps to avoid pressure spikes in the container during filling.

* * * * *